US005617604A

United States Patent [19]

Erich

[11] Patent Number: 5,617,604

[45] Date of Patent: Apr. 8, 1997

[54] PIVOTED ROLLER CUTTER PIPE CLEANING TOOL

[76] Inventor: Richard R. Erich, P.O. Box 324, Gualala, Calif. 95445

[21] Appl. No.: 301,070

[22] Filed: Sep. 6, 1994

[51] Int. Cl.[6] ..... B08B 9/04

[52] U.S. Cl. ..... 15/104.063; 15/104.061

[58] Field of Search ..... 15/104.05, 104.061, 15/104.063, 104.09, 104.12–104.16, 104.31

[56] References Cited

U.S. PATENT DOCUMENTS

| | | | |
|---|---|---|---|
| 332,910 | 12/1885 | Klein | 15/104.061 |
| 348,141 | 8/1886 | Rowell | 15/104.15 |
| 560,830 | 5/1896 | Balz | 15/104.15 |
| 576,425 | 2/1897 | Bilton et al. . | |
| 903,854 | 11/1908 | Georges et al. | 15/104.13 |
| 971,042 | 9/1910 | Hill, Jr. et al. | 15/104.061 |
| 1,181,310 | 5/1916 | Hodgman . | |
| 1,280,443 | 10/1918 | Griffin . | |
| 1,419,886 | 6/1922 | Müller | 15/104.061 |
| 1,593,072 | 7/1926 | Hayoock et al. | 15/104.061 |
| 1,596,065 | 8/1926 | Müller | 15/104.061 |
| 2,328,060 | 8/1943 | Crane et al. | 15/104.061 |
| 2,332,984 | 10/1943 | Brackeen . | |
| 2,579,813 | 12/1951 | Frank | 15/104.061 |
| 2,601,248 | 6/1952 | Brenholdt . | |
| 2,641,010 | 6/1953 | Lang et al. | 15/104.15 |
| 2,860,356 | 11/1958 | Matheny | 15/104.061 |
| 2,980,399 | 4/1961 | Littlefield . | |
| 3,047,895 | 8/1962 | Ver Nooy | 15/104.061 |
| 3,130,431 | 4/1964 | Reinhart | 15/104.061 |
| 3,262,143 | 7/1966 | Reinhart | 15/104.061 |
| 3,525,111 | 8/1970 | Von Arx | 15/104.061 |
| 3,673,629 | 7/1972 | Casey et al. | 15/104.061 |
| 4,498,932 | 2/1985 | Kruka | 134/8 |
| 4,538,316 | 9/1985 | Reinhart et al. | 15/104.061 |
| 4,573,231 | 3/1986 | Stocksiefen e tal. | 15/104.061 |
| 4,887,585 | 12/1989 | Nutt . | |
| 4,891,115 | 1/1990 | Shishkin et al. | 15/104.063 |
| 4,920,600 | 5/1990 | Reinhart | 15/104.061 |
| 5,153,963 | 10/1992 | Saxon et al. | 15/104.61 |

FOREIGN PATENT DOCUMENTS

| | | | |
|---|---|---|---|
| 5112 | 12/1905 | France | 15/104.13 |
| 999522 | 2/1952 | France | 15/104.14 |
| 400552 | 8/1924 | Germany | 15/104.061 |
| 433832 | 9/1926 | Germany | 15/104.061 |
| 832090 | 11/1952 | Germany | 15/104.31 |
| 6759 | 5/1922 | Netherlands | 15/104.061 |
| 442857 | 9/1974 | U.S.S.R. | 15/104.061 |
| 937002 | 6/1982 | U.S.S.R. | 15/104.061 |
| 1340836 | 9/1987 | U.S.S.R. | 15/104.063 |
| 1590 | 6/1910 | United Kingdom | 15/104.061 |
| 1423132 | 1/1976 | United Kingdom | 15/104.063 |

*Primary Examiner*—Mark Spisich
*Attorney, Agent, or Firm*—Daniel L. Dawes

[57] ABSTRACT

An improved pipe cleaning tool employing a cutting head and propulsor utilizes a plurality of roller cutters on the cutting head. The rolling cutters are coupled in a pairwise fashion to a rotatable car. The rotatable car in turn is pivoted to the cutting head. Each of the cars and, hence, the radial disposition of each of the roller cutters, is resiliently urged by a spring bias into a preferred radial disposition relative to the longitudinal axis of the cutting head. Moving the pipe cleaning tool through a curve or past other internal obstruction within the pipe is facilitated by rotation of the roller cutter cars and their corresponding roller cutters. In one embodiment, the propulsor disks in the propulsor unit are comprised of a plurality of rigid metal segments pivoted to the propulsor body. The propulsor disk segments rotate on the propulsor unit both during the oscillatory forward motion of the pipe cleaning tool as well as during the turning through a bend or past some other internal obstruction within the pipe. Some of the propulsor segments may also be provided with a plurality of peripheral nozzle cuts for defining fluid jets in the fluid flow passing the pipe cleaning tool. A rotatable tracker is combined with the tool to provide an electromagnetic signal directly indicating flow of fluid past the tool.

16 Claims, 6 Drawing Sheets

PIVOTED ROLLER CUTTER PIPE CLEANING TOOL

BACKGROUND OF THE INVENTION

1. Field of the Invention

The invention relates to the field of pipe cleaning or pipe cleaning tools and in particular to pipe cleaning tools or pigs which use roller cutters.

2. Description of the Prior Art

Reinhart, et al., "Pipe Cleaning Equipment," U.S. Pat. No. 4,538,316 (1985) shows a swivel propulsor unit applied to swiveled pairs of cutting heads having spring-loaded cutter arms. Reinhart '316 shows at least one cleaning unit with pivotal arms and one propelling unit in swiveled connection with each other. The pig has cleaning heads 1*a* and 1*b* and propulsion unit 2 connected by hinged knuckles 23 allowing tilting of up to 3 degrees to facilitate passage of the equipment through pipe bends. Each cleaning unit has a head 7 with four pivoted cutting arms 3 and four projecting ribs 10 for breaking and disintegrating pipe deposits. The arms have a variable profile from a triangular shape near the pivot and axis to dual contact areas near the rear end of the arms. The variable profile provides a means for splitting the deposits at the leading edge and scraping the deposits at the rearward edge. The arms have up to four rollers 30, best depicted in FIG. 2, to facilitate passage of the cutters through pipe valves and other bends without effecting the cleaning efficiency of the device.

Reinhart's '316 rollers 30 in the depiction of FIG. 2 are placed on a section of cutter arm 3 that normally is not used for cutting or breaking the pipe deposits. Rollers 30 themselves do not appear to be used in any cutting function. See column 6, lines 36–46. Reinhart '316 uses the rollers for facilitating movement through valving and pipe bends on a pivoted arm. Reinhart '316 fails to show a cutting function combined with the rolling element.

Reinhart, "Pipe Cleaner," U.S. Pat. No. 4,920,600 shows a pipe cleaner with flexible propulsor disks identical to Reinhart '316 but rigidly connected via a shaft to a plurality of entirely rigid cutters on a fixed cutter head. Reinhart '600's propulsor disks are made from leather which rapidly degrade in the hot caustic environment of a geothermal pipe and the tool has no means for bending or flexing to accomodate bends or internal restrictions within the pipe.

Brenholdt, "Pipe Line Cleaner and Locator," U.S. Pat. No. 2,601,248 (1952) shows a locator having a rotating magnet which rotates at approximately 5 Hertz combined with a pipe line scraper. The magnet is deployed in the scraper so as to avoid any type of interference with the cutting operation. An electric motor is used to turn the magnet and is powered by a battery. Magnet 16 is mounted on shaft 14 turned by motor 12 powered by battery 10. The substitution of an electromagnet for the permanent magnet is contemplated through the use of an interrupter circuit. See column 4, lines 5–39.

Brenholdt contemplates a separate power source for rotating the magnet as opposed to utilizing the fluid flow within the pipe. Clearly, Brenholdt's embodiment would likely be inoperable in a hot, corrosive and hostile environment unless very well sealed and insulated.

Saxon et al, "Tube Cleaning Tool for Removal of Hard Deposits," U.S. Pat. No. 5,153,963 (1992) shows a pig having a plurality of spaced freewheeling cutter wheels. Tool 1 with cylindrical body 3 has a truncated nose 27 with a nose portion 5. The main cylinder member 13 has cutting wheels 11 supported so that only a small portion of the wheel extends outwardly from the body envelope. The body is sized to be less than the tube diameter 67 to be cleaned and wheels 11 extend between the hard deposits and wall 71 of the pipe. Saxon has the roller cutters rigidly mounted in the cutting head.

Nutt, "Method and Apparatus for Cutting Taps in Sewer Lines," U.S. Pat. No. 4,887,585 (1989) describes a tool using a hydraulic-driven self-propelled cutter that cuts close to the side wall of a pipe without jamming. Tap cutter 10 has a frame 18 with hydraulic motor 14 having shaft 15 supporting and turning a bit 16. Frame 18 has four skids 20A and B, 22A and B, with rollers to allow passage of the assembly through the pipe, to allow passage over offsets in the pipe, to prevent rotation when used in the pipe. The use of the roller is provided at the end of the skids is described principally for improving the ability of the pipe to travel over offsets and intruding seams in the pipe. See column 4, lines 46–61. The rollers are not used for any cutting function, but only for stabilization of the frame during the tapping operation by bit 16. See column 5, lines 18–22.

Bilton et al., "Appliance for Scraping Interiors of Water Mains or Pipes," U.S. Pat. No. 576,425 (1897) describes a pig for cleaning rust, silt or deposits in a pipe which is designed to enable it to pass any permanent obstruction in the pipe and to go around ordinary bends. A spindle is fitter with two cones B and C, having radial grooves b and c holding pivotal cutters D and E. Resilient rings and washers are provided for adjusting the degree of pressure that the cutters will have against the interior of the pipe. The rear spindle is fitted with a ring N to which, if preferred, a bar magnet may be attached used in combination with a compass in order to locate the scraper.

Bilton shows rotatable cutting arms D and E used in combination with a magnet for purposes of location tracking. However, Bilton's cutters are not roller cutters and the magnet is not rotating.

Brackeen, "Cleaning Device for Pipe Lines," U.S. Pat. No. 2,332,984 (1943), shows a fluid pressure propelled pipe cleaning device which employs nozzle action to effect a first level of cleaning. As shown in FIGS. 1–6, the device which is inserted lengthwise into the pipe includes a head 12*a*, a series of flexible sealing disks 12*b* and 13, and brake shoes 21 and 22 for maintaining frictional contact with the inner surface of pipe 10. You will note parenthetically that FIG. 2 shows a rigid connection of a shaft from propulsor disks 13 into a cutting head 12*a*. Numerous water jets 14, 15 and 16 are defined in head 12*a*. The disk and brakes form a seal. Fluid is captured behind the device which generates the necessary pressure to propel it through the pipe. Some of the high pressure fluid is nozzled through jets 14, 15 and 16 so that the water stream exiting from these jet erode and dissolve the softer portions of material built up within pipe 10 immediately in front of the pig. Material not removed by the fluid jet action is subsequently scraped away by means of disks and brakes 12*b*, 13, 21 and 22.

Griffin, "Tube Cleaning Tool," U.S. Pat. No. 1,280,443 (1918), shows a tube cleaning tool used for tubes of condensers and the like. As shown in FIGS. 1 and 2, the tool has a front section with a helical scraper blade 1 and has a rear section piston 3 having a boss 7 defined thereon. In operation, the tool is inserted into the pipe to be cleaned and then propelled through it by high pressure water flow. Since the diameter of piston 3 is less than the interior diameter of pipe b, nozzling effect would inherently result as part of the propelling water is deflected by boss 7 through the space between piston 3 and the inner surface of pipe b out to the front section.

Hodgman, "Pipe Cleaning Machine," U.S. Pat. No. 1,181,310 (1916), shows a fluid propelled pipe threader. The device is intended to be used for Car the end of heavy rope or cable through pipe. However, the device employs a fluid effecting disk similar to your own concept. As shown in FIGS. 1–5, the device comprises an elongated buoyant body 1 having formed thereon a series of flexible disks 10 which are concentrically spaced apart. The diameter of disk 10, which project radially outward from the axis from the elongated body 1, are less than the inner diameter of pipe A through which the device is propelled. Consequently, pressurized fluid hitting the rear surface of the rearmost disk 10 imparts a driving force. The defective fluid passing through the space between the peripheral edge of each disk 10 and inner surface of pipe A jets forward to impart a driving force against the surface of the next disk 10. It is apparent that the force producing agitation of fluid created by the resulting nozzling effect in the case of the front most disk 10 will result in some erosion or dissolution of material lining the inner surface $a^1$ of the section of pipe A immediately ahead of the device.

Littlefield, "Flow Propelled Sewer or Pipe Threader," U.S. Pat. No. 2,980,399 (1961), shows a device in FIG. 1 comprised of pistons 8, cleaning blades 12, rollers 18 and 20 and deflectors 11. As pressurized fluid imparts propelling force on pistons 8, some of the fluid passes through openings formed through pistons 8, passes by cutting blades 12 and is deflected around deflector 11. The fluid so deflected is jetted outward against the inner surface of the pipe at a point where the cleaning members engage the encrusted matter to be removed. The fluid disturbance dissolves and carries away the scraped residue.

Kruka, "Pipeline Pig with Restricted Fluid Bypass," U.S. Pat. No. 4,498,932 (1985), shows a pig which employs fluid nozzling to aid in pipe buildup removal. As shown in FIGS. 1–3, the pig comprises a foam body, a fluid passageway 1 and orifice 8. When inserted into a pipe and projected through the pipe by fluid flow, the outer surface of the pig's body, which conforms to the inner diameter of the pipe to be cleaned, functions to scrape away the built up material. Passageway 1 allows fluid from the back of the pig to flow to the front where it is nozzled by a set of outwardly directed jets 9 shown in FIG. 3. The resulting streams of fluid serve to agitate and suspend at least the soft portion of the build up just prior to scraping.

BRIEF SUMMARY OF THE INVENTION

The invention is an improvement in a pipe cleaning tool having a propulsor unit and a cutting head coupled to the propulsor unit. The improvement comprises a plurality of roller cutters disposed on the cutting head. Each of the roller cutters is pivotally coupled to the cutting head by a corresponding roller cutter pivot so that radial disposition of each of the roller cutters with respect to the pipe cleaning tool is variable according to rotation of the roller cutter about the roller cutter pivot coupling the roller cutter to the cutting head. As a result, bends and internal obstructions within a pipe cleaned by the pipe cutting tool are accommodated. In fact when the tool move through a bend at least two of the roller cutters are in contact with the interior surface of the pipe instead of just one. This results in less likelihood of scarring or cutting into the pipe interior surface, which can be a problem where the pipe is provided with a concrete inner liner.

The improvement further comprises an element for biasing each of the plurality of roller cutters in a predetermined radial disposition with respect to the cutting head.

The improvement further comprises a plurality of roller cutter cars. Each of the roller cutters is coupled to one of the cars about the corresponding roller cutter pivot pin. The car in turn is pivotally coupled to the cutting head by a car pivot pin. The result is that the rollers, while biased and rotatable in a pairwise fashion, are otherwise rigidly or incompressible fixed to the cutting head unlike resiliently mounted cutters or cutting blades. The amount of radial compression of each roller is limited by the degree of rotation permitted by the rotatable coupling of each car to the cutting head.

The element for biasing comprises a spring mechanism bearing against the roller cutter car to rotate the roller cutter car about the car pivot pin into a preferred disposition on the cutting head. The plurality of roller cutters are coupled together to form pairs of rollers. Each pair of rollers is collectively rotatable with respect to the cutting head.

The plurality of roller cutters are coupled together to form pairs of rollers. Each pair of rollers is collectively rotatable with respect to the cutting head.

The cutting head has a longitudinal axis and further comprises a cutting disk coupled to the cutting head and extending radially with respect to longitudinal axis of the cutting head. The cutter disk defines a plurality of nozzles for creating high velocity flows of fluid past the cutting disk to hydraulically remove encrustations in the pipe. Each of the nozzles comprises a nozzle cut defined with a periphery of the cutting disk.

The improvement further comprises a turbine-driven tracking device for creating a fluctuating electromagnetic signal proportional to fluid flow past the tool by which the pipe tool may be tracked within the pipe. The device also indicates if the flow is sufficient to move the tool, because the fluctuating signal is proportional to flow, similar to an in-line turbine flow meter. The flow can drop off due to a plug or other obstruction forming downstream from the tool. The turbine-driven tracking device comprises a disk, a plurality of spaced apart permanent magnets affixed to the disk, and a turbine affixed to the disk for rotating the plurality of magnets in response to fluid flow past the tracking device.

The propulsor unit comprises at least one propulsor disk. The disk comprises a plurality of rigid segments pivotally coupled to the pipe cleaning tool. These propulsor disks can be increased in diameter by an insert that is placed on or at its outer diameter. The improvement further comprises a stop for limiting rotation of each of the rigid segments in at least one predetermined direction.

The pipe cleaning tool has a longitudinal axis and the propulsor unit has a plurality of propulsor disks. Each of the propulsor disks are comprised of a plurality of the rigid segments. The plurality of segments on one propulsor disk is angularly offset about the longitudinal axis of the pipe cleaning tool with respect to the plurality of segments of another one of the propulsor disks so that longitudinal fluid flow past the pipe cleaning tool within the pipe impinges against at least one of the rigid segments.

Each of the segments on each propulsor disks is angularly spaced one from the other such that the segments may be rotated in a rearward direction relative to forward movement of the pipe cleaning tool without substantial interference with other segments on the same propulsor disk.

Each of the segments has a radial outermost peripheral edge and at least some of the disk segments further comprise a plurality of nozzles defined through the peripheral edge to define high velocity fluid flow through the peripheral edge for providing fluid jets for removing encrustations from the pipe. The nozzles comprises a nozzle cut radially defined with a periphery of the segment.

The invention is also characterized as a method for moving a pipe cleaning tool through a pipe having bends or internal obstructions therein while removing encrustations disposed within the pipe. The method comprises the steps of providing a plurality of roller cutters on a cutting head of the pipe cleaning tool and a propulsor unit coupled to the cutting head. The roller cutters are pivotally coupled to the cutting head. The radial disposition of the roller cutters from a longitudinal axis of the cutting head is varied as the pipe cleaning tool is moved through the bends or internal obstructions to vary the effective cutting diameter of the pipe cleaning tool. As a result, the bends and internal obstructions are more easily navigated by the pipe cleaning tool within the pipe.

The step of varying the radial disposition of the roller cutter from the longitudinal axis of the cutting head comprises the step of providing the roller cutters by pairs on a rotatable car. The car is rotatably coupled to the cutting head. Each pair of rollers cutters is urged into a predetermined preferred radial disposition from the longitudinal axis of the cutting head.

The method further comprises the steps of providing a plurality of peripheral nozzles around a radial circumference of the pipe cleaning tool and directing fluid jets through the nozzles into the encrustation in the pipe.

The method further comprises the steps of spinning at least one permanent magnet to create a radiating electromagnetic field, proportional to the flow past the tool and providing rotary motion to the spinning magnet by a turbine driven by fluid flowing past the pipe cleaning tool.

The invention is better visualized by now turning to the following drawings wherein like elements are referenced by like numerals.

The invention and its various embodiments may now be better understood by turning to the following detailed description.

DETAILED DESCRIPTION OF THE PREFERRED EMBODIMENTS

An improved pipe cleaning tool employing a cutting head and propulsor utilizes a plurality of roller cutters on the cutting head. The rolling cutters are coupled in a pairwise fashion to a rotatable car. The rotatable car in turn is pivoted to the cutting head. Each of the cars and, hence, the radial disposition of each of the roller cutters, is resiliently urged by a spring bias into a preferred radial disposition relative to the longitudinal axis of the cutting head. Moving the pipe cleaning tool through a curve or past other internal obstruction within the pipe is facilitated by rotation of the roller cutter cars and their corresponding roller cutters.

The pairs of roller cutters are combined with a hydrolasing action with a following cutter disk having a plurality of nozzle cuts defined through its radial periphery. Each nozzle cut defines a fluid jet which is directed into the encrustation in the pipe.

In one embodiment, the propulsor disks in the propulsor unit are comprised of a plurality of rigid metal segments pivoted to the propulsor body. The propulsor disk segments rotate on the propulsor unit both during the oscillatory forward motion of the pipe cleaning tool as well as during the turning through a bend or past some other internal obstruction within the pipe. Some of the propulsor segments may also be provided with a plurality of peripheral nozzle cuts for defining fluid jets in the fluid flow passing the pipe cleaning tool.

A rotatable tracker is combined with the tool to provide an electromagnetic signal directly indicating flow of fluid past the tool.

Figure 1:
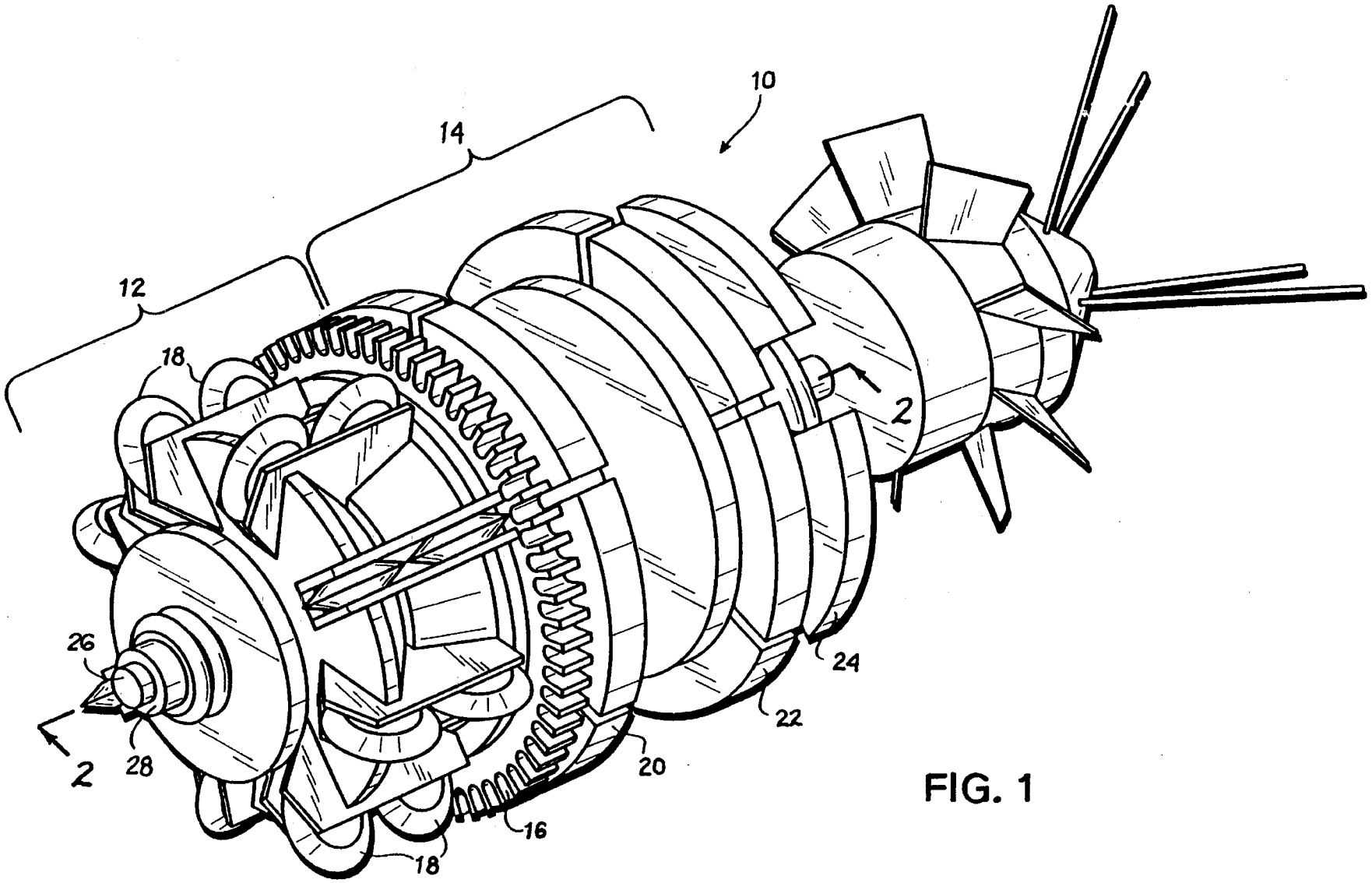
FIG. 1 is a perspective view of the pipe cleaning tool of the invention.

FIG. 1 is a perspective view of the pipe cleaning tool or pig, generally denoted by reference numeral 10. Tool 10 is comprised of two sections. A cutting head denoted by portion 12 and a propulsor unit denoted by portion 14. In the illustrated embodiment, cutting head 12 is principally comprised of a scrapping disk 16 and a plurality of roller cutters 18 mounted on cutting head 12 as best depicted in the from elevational view of FIG. 3. Roller cutters 18 radially extend from longitudinal shaft 34 of cutting head 12 shown in FIG. 2 and in the illustrated embodiment are beveled metal wheels having a center circumferential cutting edge. Propulsor unit 14 may employ any type of pipe tool propulsor now known or later devised. The illustrated embodiment is shown as a two-stage propulsor comprised of a front propulsor disk 20 and two rear propulsor disks 22 and 24.

Figure 2:
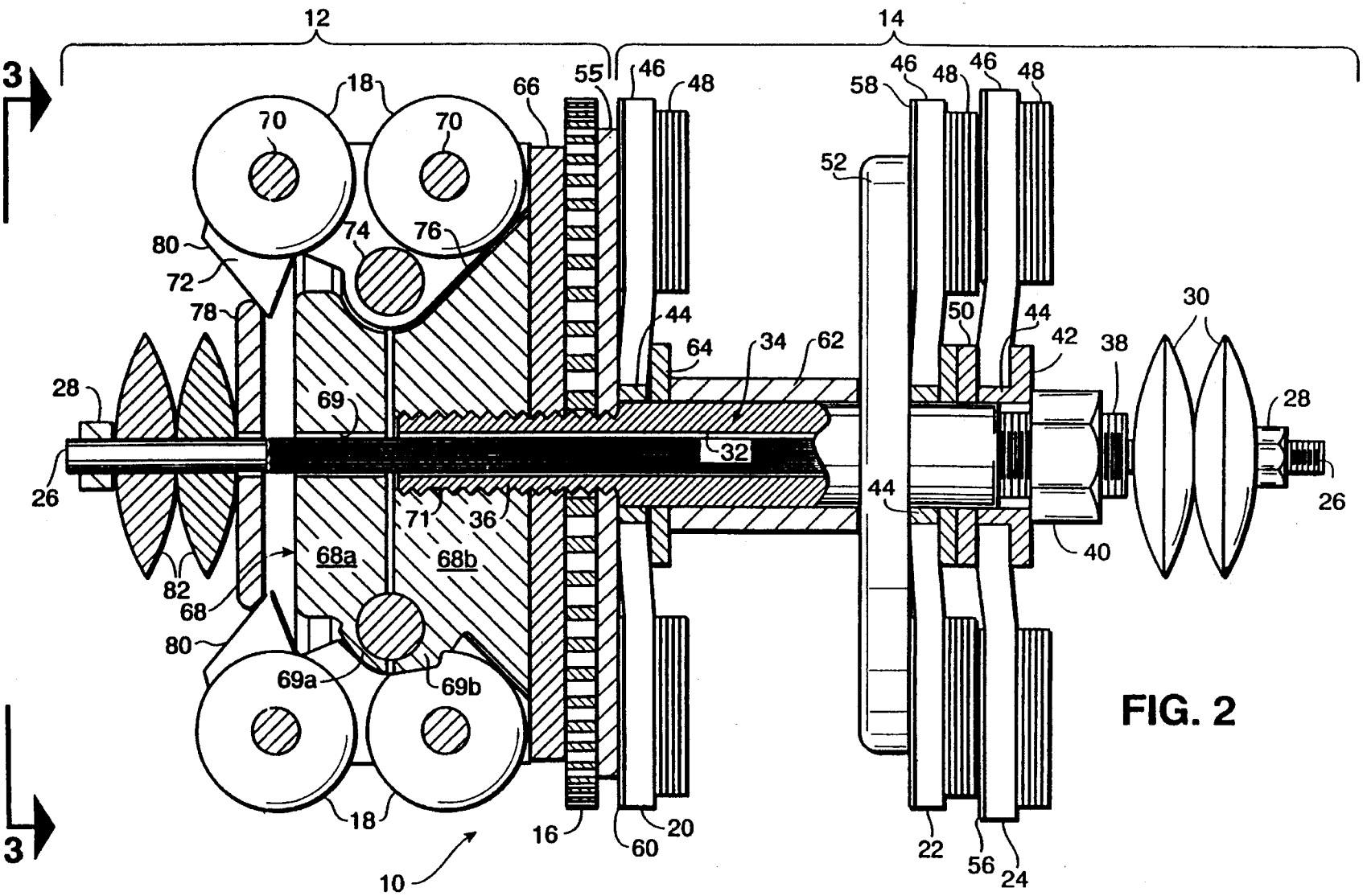
FIG. 2 is a side cross sectional view of the pipe cleaning tool of FIG. 1 as seen through section lines 2—2 of FIG. 1.

Cutting head 12 and propulsor unit 14 are rigidly coupled together by means of a rigid longitudinal axial threaded shaft 34 which is depicted in the side cross-sectional view of FIG. 2. Although rigid coupling is shown, it is also expressly contemplated that any type of flexible coupling between cutting head 12 and propulsor unit 14 now known or later devised may also be employed.

FIG. 2 is a side elevational view in which the front portion is shown in partially cutaway side cross sectional view as would be seen through lines 2—2 of FIG. 1. Beginning with the rear end of tool 10 which is shown to the right in FIG. 2, one or more bellows springs 30 are fastened underneath the rear end nut 28 and retained thereby on an axial flexible steel cable 26. Cable 26 continues to the left in FIG. 2 through a bore 32 defined in a shaft 34. Shaft 34 is a cylindrical mandrel or spine having an inner bore 32 with an inner diameter greater than the outer diameter of cable 26. The front or left end of shaft 34 as shown in FIG. 2 is a reduced diameter segment 36 which is threaded and screwed into cutting head 12. The rear end of shaft 34 is a reduced diameter segment 38 which is threaded to accept a tightening nut 40. Nut 40 bears against a washer 42. Washer 42 transmits the pressure from tightening nut 40 into the first rearmost propulsor disk 24. Propulsor disk 24 is spaced from shaft 34 by means of a ring spacer 44. Spacer 44 also limits the amount of compression on the propulsor disk. Propulsor disk 24 is separated from the next rearmost propulsor disk 22 by means of two washers 50. Propulsor 22 is also spaced apart from shaft 34 by means of a spacer ring 44 as is propulsor 20. Propulsor disk 24, as is the case with each of the propulsor disks 20 and 22 in the embodiment of FIG. 2, is comprised of a flexible disk 46 which may be divided by radial slots (not shown) into a number of sectors. Typically, the radial slots, if provided, will extend only part way to the center of each propulsor disk thereby providing a central integral web through which each of the radial segments remain connected. Each segment is then provided with an inertial mass 48, which typically is a metal weight.

Slidingly disposed on shaft 34 along with washers 42, 50 and spacers 44 is a propulsor plate 52. Propulsor plate 52 is comprised of a rigid metal plate providing structural reinforcement for propulsors 22 and 24. In operation, substantial pressure and fluid flow in the pipe in which tool 10 is inserted builds up behind propulsors 20, 22 and 24. Tool 10 is then forced forward or to the left as shown in FIG. 2, cutting into or breaking the internal encrustations deposited in the pipe. Generally the forward movement is sudden upon the fracture of the encrustation. Any sudden forward drive causes propulsor disk 20, 22 and 24 to flex backward to the right in FIG. 2 due to inertial weights 48. Tool 10 then becomes stopped by the encrustation and the water pressure, or more specifically, the large water column or hammer behind propulsor disks 20, 22 and 24, slams against the rear surfaces of the propulsor disks. This pushes each of the disks forward, which in this case, forces propulsor disk 24 against propulsor disk 22, which in turn is forced against propulsor plate 52. Propulsor 20 is similarly forced forward against a reinforcing plate 55, serving a function similar for propulsor as propulsor plate 52 serves for propulsors 22 and 24.

To assist in the co-action of propulsor plates 22 and 24, the forward portion of rear propulsor disk 24 is provided with a plate or shim 56, which is positioned for contact with inertial weights 48 of propulsor disk 22. Similarly, propulsor disk 22 is provided with a shim 58 for contact with propulsor plate 52, and propulsor 20 with a shim 60 for contact with reinforcing plate 55.

Once the water hammer slams against tool 10, it is again driven forward and the process repeated very rapidly and sometimes at an audio frequency, depending upon the geometry and mass of the tool, size of the pipe and water pressure and flows within in the pipe. Vibration in the tool sets up audio vibrations within the tool or pipe such that on many occasions tool 10 emits a squealing sound, and hence the use of the term "pig" to describe tool 10.

Propulsor plate 52 maintained in position within propulsor unit 14 by means of a cylindrical collar 62 slidingly disposed over shaft 34. Cylindrical collar 62 in turn abuts against washer 64 and is slidingly disposed on shaft 34 against the rear surface of propulsor 20. These elements thus complete those elements generally considered as being included within propulsor unit 14.

Within cutting head 12 is a serrated or convoluted scraper plate 16 slidingly disposed upon segment 36 of shaft 34 in front of reinforcing plate 55. Slidingly disposed on segment 36 in front of scraper plate 16 is a smaller diameter reinforcing plate 66. Also disposed on segment 36 of shaft 34 is a cutter support head 68 which provides a means of carrying the plurality of pivoted roller cutters 18.

Figure 3:
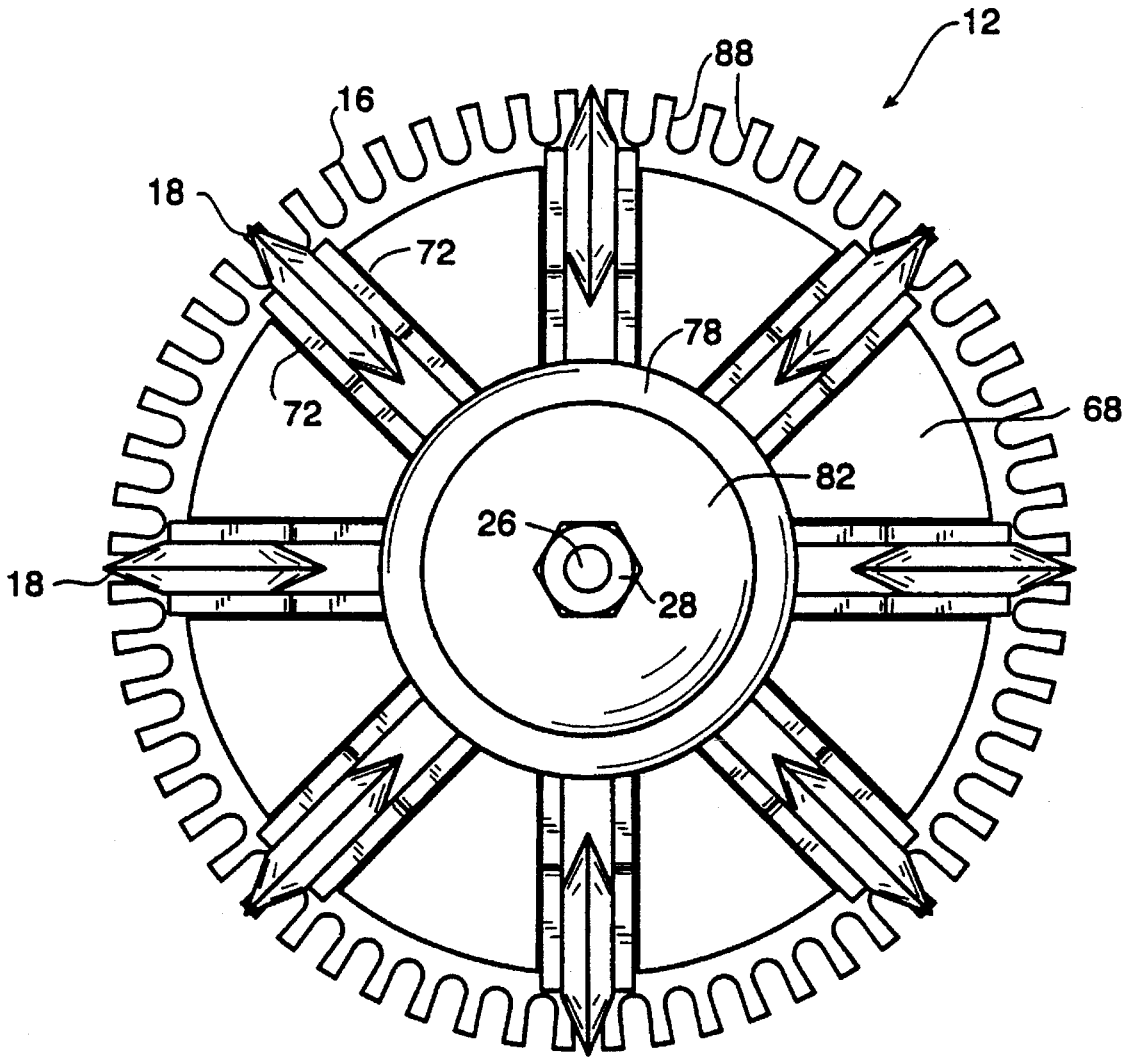
FIG. 3 is a front elevational view of the pipe cleaning tool of the invention as seen through lines 3—3 of FIG. 2.

As better depicted in FIG. 3, in the illustrated embodiment, roller cutters 18 are azimuthally disposed equally distant around the periphery of support head 68. Cutters 18 are paired. The pair of cutters are rotatable about cutter pins 70 of FIG. 2 which are connected to car 72. Car 72 is comprised of two parallel plates shown in side view in FIG. 2 and end view in FIG. 3. Cutter pins 70 of FIG. 2 are connected between the two sides of car 72. Car 72 in turn is pivoted about a pin 74 connected to support head 68 as depicted in FIG. 2. The clockwise motion of the upper car 72 shown in FIG. 2 is limited by surface 76 while the counterclockwise rotation of the same car 72 as shown in FIG. 2 is restricted by means of a spring loaded disk 78. The opposite rotational displacements of the lower car 72 shown in FIG. 2 is similarly limited as is each of the plurality of cars 72 pivotally coupled to head 68. Disk 78 is resiliently compressed by means of a pair of bellow springs 82 disposed over cable 26 and compressed by means of tightening nut 28 on the forward end of cable 26. The outer peripheral edge of disk 78 bears against an inclined surface 80 of car 72, which tends to urge the upper car 72 shown in FIG. 2 in its counterclockwise-most position, i.e. in a configuration where the forward cutter 18 is resiliently and inwardly urged to a radially retracted position.

The resilient bias of car 72 into a downwardly inclined position, which will tend to position the rear wheel cutter 18 at a slightly higher radial position from cable 26, and hence away from the center of the pipe than the forward cutter 18. Nevertheless, when tool 10 is forced through a curve, elbow, fitting or other internal obstruction within the pipe, each pair of cutting wheel 18 is free to rotate about pivot 74 against the compression bias of disk 78 to lower the front most cutter wheel 18 in each car 72. The result is that tool 10 is substantially easier to force around bends and elbows in the pipe, and has a dramatically lesser tendency to gouge or cut into the interior surface of the pipe at such restrictions as is typically the case with prior art cutters having fixed cutting elements in the cutting head 12.

In addition the biasing of cutter wheels 18 lessens the chance that tool 10 can become awkwardly cocked at an angle within the pipe and jammed into the cocked position. If tool 10 does become cocked and stops, decreasing the fluid flow will tend to allow tool 10 to back off from the cocked position by reason of the resilient loading of the cutter wheel pairs.

Moreover, the flexibility of cable 26 allows plate 78, which bears against cars 72 to create the resilient force on cutter wheels 18, to easily assume sharply inclined positions. Typically, only one or two cars 72 will ever be significantly rotated by reason of the position of tool 10 in the pipe and the flexibility of cable 26 permits more independent rotation of cars 72 one from the other.

Support head 68 may be integral or as in the illustrated embodiment, comprised of two segments, a front segment 68*a* and a rear segment 68*b*. Front segment 68*a* has a bore 69 to provide clearance for cable 26. Rear segment 68*b* is provided with a threaded bore 71 to screw into portion 36 of shaft 34. Front segment 68*a* is then secured to rear segment 68*b* by means of a plurality of flush bolts extending through front segment 68*a* and threaded into rear segment 68*b*. Segments 68*a* and 68*b* have journal halves (not shown) defined in them to provide in combination a complete a rotatable pivot or at least a fitting or coupling for pins 74 to which cars 72 are rotatably attached.

Figure 4:
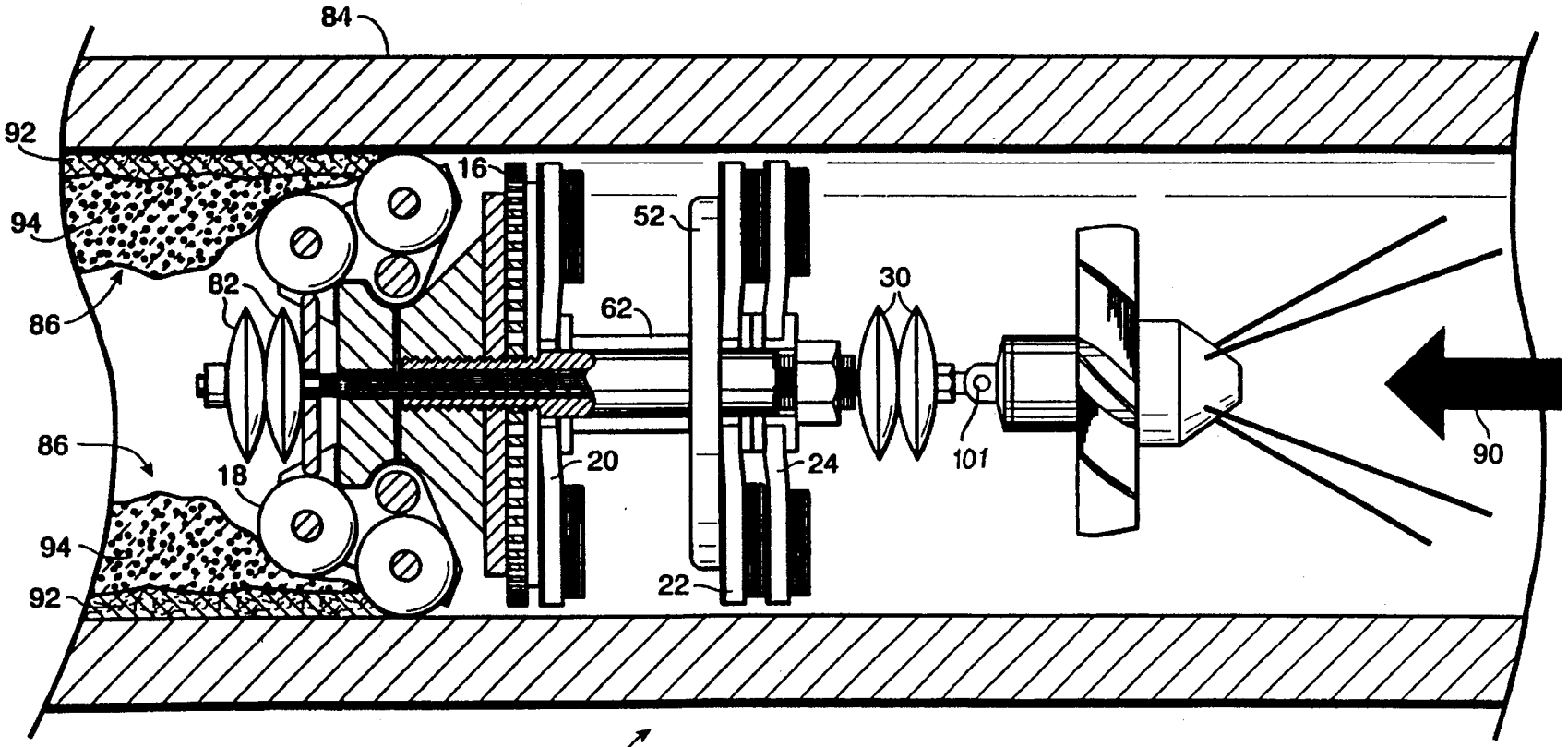
FIG. 4 is a side elevation view of the pipe cleaning tool of FIG. 2 shown in the environment of a partially clogged pipe illustrating the method of hydrolyzing.

FIG. 4 diagrammatically depicts in side elevational view tool 10 disposed within a pipe 84 having an internal encrustation 86. Scraper plate 16, as depicted in side view in FIG. 2, and is better depicted in frontal view in FIG. 3, is provided with a plurality of nozzle cuts 88 along its entire periphery. Cuts 88 provide a means of allowing the substantial fluid flow, diagrammatically depicted by arrow 90, to flow pass tool 10, and in particular scraper plate 16, while being focused into a plurality of directed nozzles or high speed jet flows. The high volume flow of fluid 90 through pipe 84 thus becomes an even higher velocity flow within nozzle cuts 88. In many applications, encrustation 86 has a relative outer soft layer 92 disposed next to the inner diameter of pipe 84. Inside softer layer 92 is a harder layer 94. Such deposits, for example, are often found in the piping systems of geothermal plants. Softer portion 92 around the periphery of tool 10 is thus generally aligned with the periphery of scraper plate 16 and is subjected to the direct impingement of the high velocity jets channelled through nozzle cuts 88. The relatively softer layer 92 inside the harder layer 94 of encrustation 86 is forcefully washed away or hydrolased and the remaining hard cylindrical core 94 broken up by cutters 18 and washed downstream in chunks.

Nozzle cuts 88 are shown in the embodiment of FIG. 3 as U-shaped cuts, but may be provided with any type of cross sectional profile known to the art. For example, it is entirely within the scope of the invention that closed orifices, such as circular orifices, having predetermined angles to provide an angled jet, may also be defined in place of the form of nozzle cuts 88 illustrated.

Figure 6:
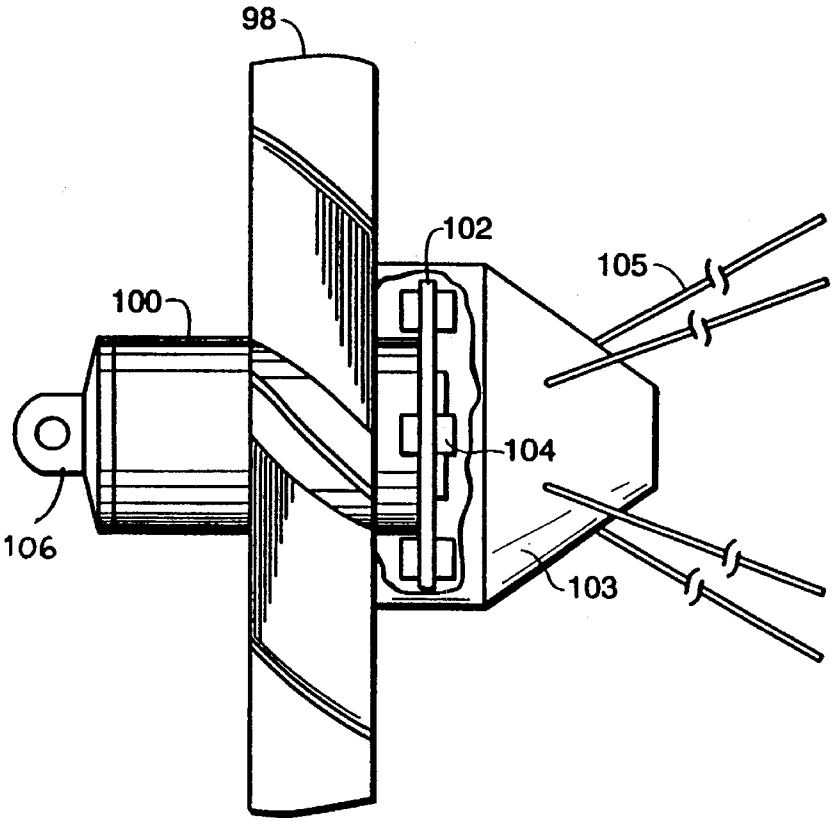
FIG. 6 is a side elevational view of the tracking device of FIG. 5.
Figure 5:
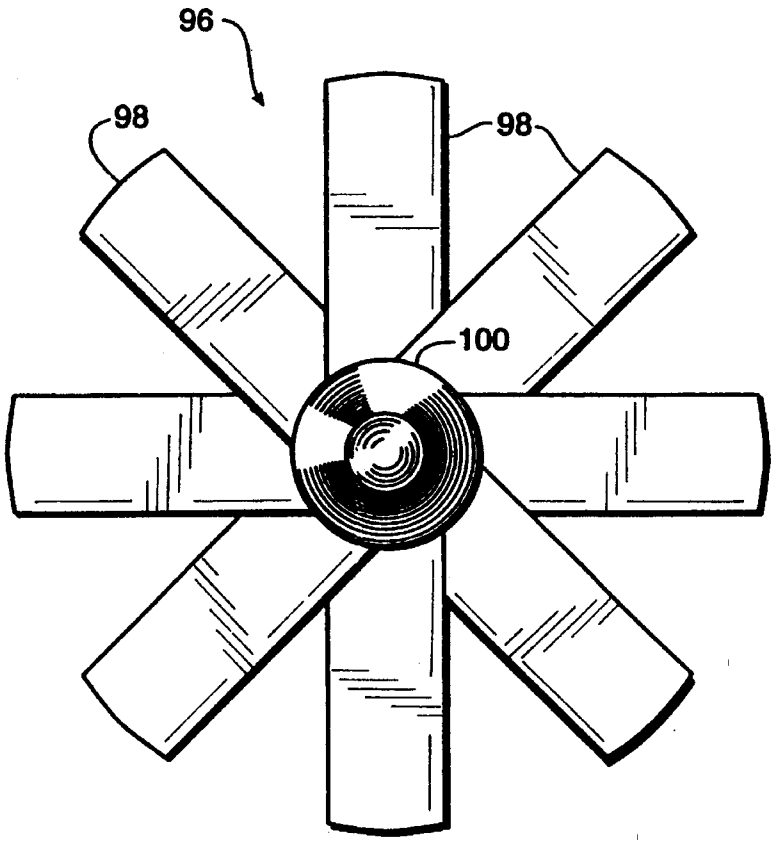
FIG. 5 is a front elevational view of a turbine-driven tracking device used in combination with the pipe cleaning tool of FIGS. 1–4.
Figure 12:
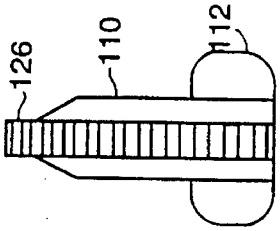
FIG. 12 is a side cross-sectional view of the segment shown in FIG. 11.

FIG. 5 illustrates a tracking device which may be used in combination with the present invention. FIG. 5 is a front plan view of a turbine-driven rotating device, generally denoted by reference numeral 96, shown in enlarged scale relative to the illustrations of FIGS. 1–4. FIG. 6 is a side elevational view of the turbine-driven tracking device of magnet of FIG. 5.

Tracking device 96 is comprised of a plurality of angled blades 98 which are attached to a rotatable hub 100. A plurality of permanent magnets 104 are attached, press-fit or otherwise connected or coupled to hub 100. Hub 100 rotates about a captured pivot pin 106 depicted in FIG. 6. Pivot pin 106 in turn is connected to the rear end of cable 26 by means of a universal joint 101 as best shown in FIG. 4. Magnets 104 are contained and protected in a housing 103 attached to hub 100. A plurality of flexible rod feelers 105 extend from housing 103 to form a spider array in order to maintain tracker 96 more or less parallel to the axial fluid in the pipe.

Rotation of magnets 104 creates an oscillating electromagnetic field proportional to the flow which can be easily detected by a conventional magnetometer exterior to pipe 84 even when pipe 84 has thick ferrous or steel walls. Previous attempts to track pipe cleaning tools carrying a stationary magnet experiences practical difficulties in locating the magnet precisely or at all, particularly in ferrous pipes. The changing magnet field of the rotating magnets on device 96 provides a clear and exceedingly strong signal for locating tool 10 within pipe 84 unambiguously over a wide variety of flow conditions.

In addition to serving as a means of providing position identification for the tool, tracker 96 also acts as a in-line flow meter in the pipe. From the frequency of signal detected, the amount of fluid flow can be readily determined. Situations where the tool has become stuck in the pipe can then be immediately distinguished from situations where a downstream blockage has begun to be created and the flow rate has fallen below an effective minimum.

Figure 9:
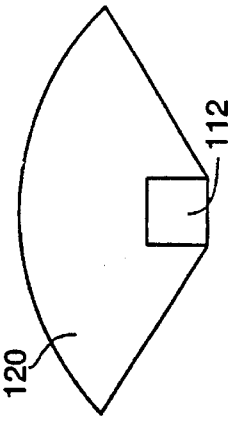
FIG. 9 is a plan view of one of the propulsor disk segments used in a rear propulsor disk of the propulsor unit of FIG. 7.
Figure 8:
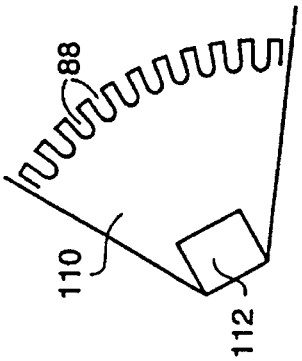
FIG. 8 is a plan view of one of the propulsor disk segments used in a forward propulsor disk of the propulsor unit of FIG. 7.
Figure 7:
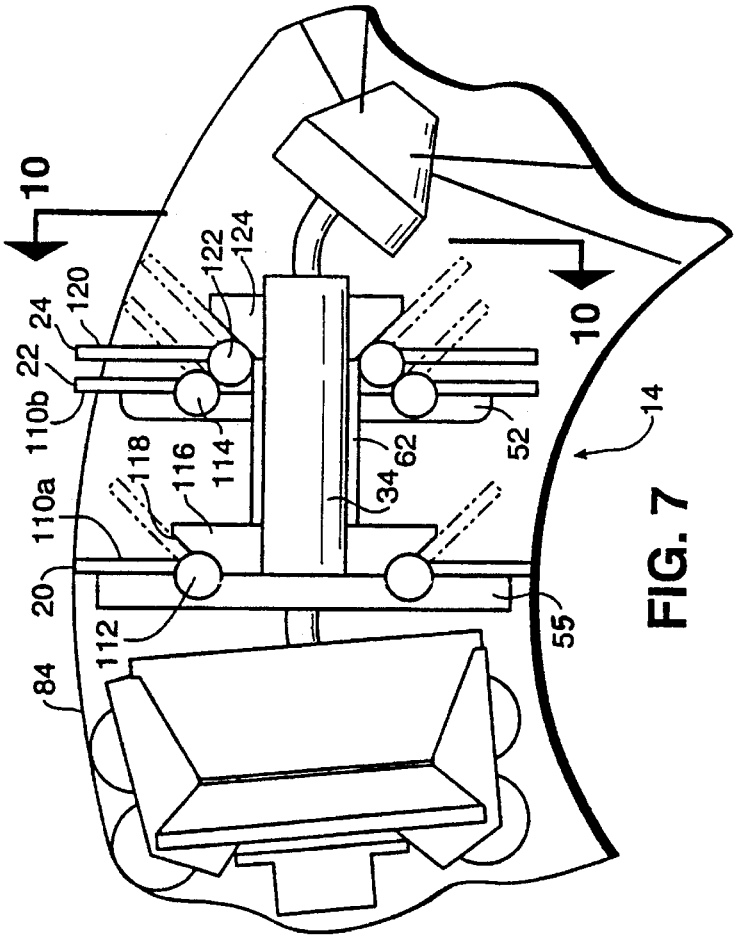
FIG. 7 is a diagrammatic side cross-sectional view of one embodiment of the propulsor being disposed through a pipe bend.

FIG. 7 illustrates an alternative embodiment of the propulsor unit 14 of the invention diagrammatically showing its configuration in a curved section of pipe 84. In the embodiment of FIG. 4, propulsors 20, 22 and 24 are comprised of rigid sector plates such as shown in FIGS. 8, 9 and 1. For example, propulsor 22 and 24 are comprised of a plurality of pie-shaped rigid metal sector plates 110*a* or 110*b* of the form shown in FIG. 8 and are pivoted about a fixed pivot 112 and 114, respectively, shown in FIG. 7. Sector plate 110*a* or 110*b*, which is typically made of metal, is provided with a plurality of nozzle cuts 88 in a manner similar to that described in connection with scraper plate 16 in FIG. 3. The forward rotation of sector plates 110*a* and 110*b*, which is clockwise for the upper plate shown in FIG. 7, is limited as before by structural plate 54 for propulsor 20 and propulsor plate 52 for propulsor 22. The rearward motion of sector plates 110*a* is limited in the case of propulsor 20 by a conical collar 116 which replaces washer 64 used in the embodiment of FIG. 2. Collar 116 has an inclined surface 118 which provides a stop for sector plate 110*a* shown in dotted outline when in its rearmost position.

Similarly, rearmost propulsor 24 is comprised of a plurality of sector plates 120 pivoted about corresponding pivot points 122. Sector plate 120 differs from sector plates 110*a* and *b* in its size as well as the fact that it is generally solid without having nozzle cuts 88 defined in its periphery. The rearward motion of sector plates 120, which for the upper plates shown in FIG. 7 is clockwise, is similarly limited by frustoconically shaped collar 124, which replaces washer 42 of the embodiment of FIG. 2. The rearward motion of sector plate 120 is similarly shown in dotted outline in FIG. 7.

Replacing the flexible propulsor disks 46 of the embodiment of FIG. 2 with a plurality of corresponding rigid plate segments 110*a*, 110*b* and 120 in the embodiment of FIG. 7 provides a more rugged and durable propulsor unit 14 than in practice is achieved with the design of the embodiment of FIG. 2. In the embodiment of FIG. 2, as is conventional in the art, propulsor disks 46 are made of a resilient flexible material which in the prior art has varied from natural leathers to reinforced rubber sheet. When used in hot brine geothermal wells or piping with flows of the order of 5000 gallons per minute and pressures of 450 psi at temperatures of 350 degrees Fahrenheit, it has been found that natural materials, such as reindeer hide used for propulsor disks 46 disintegrate in a single usage and that even when specially formulated, reinforced rubber disks are used, the thermal, mechanical and chemical attack of the hot brine solution upon the material of propulsor disks 46 is such that their use is limited, often lasting no more than one run or cleaning.

The use of metal plate in place of flexible propulsor disks 46 in the embodiment of FIG. 7, thus avoids the severe deterioration experienced by the propulsor disks in these types of hostile environments. Further, because the mass of the plate itself is significant, the need for inertial weights 48 are eliminated thereby reducing fabrication costs and expense as well as an additional source of maintenance problems concerning the secure attachments of such weights to the disks. The loss of the inherent resiliency of disks 46 in the embodiment of FIG. 2 is more than amply compensated by the pivoting of the sector segments shown in FIG. 7.

Figure 11:
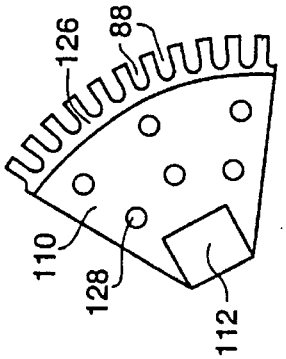
FIG. 11 is a plan view of an insert added to one of the sectors of the propulsor disk.

As shown in FIG. 11 inserts 126 with nozzle cuts 88 defined in their peripheral edges can be bolted to segments 110 or 120 by bolts 128 to increase the diameter of each segment without having to replace the whole segment. It is thus expressly contemplated that a single tool may be repeatedly reassembled with a plurality of increasingly larger diameter cutting and propulsor elements to then be used to cut a series of larger and larger bores through the pipe. This type of approach is particularly advantageous in extremely hard deposit pipe encrustations. Thus either a larger cutting head 12, larger cutting wheels 18 and a larger scraper plate 16 could be assembled with correspondingly larger propulsor disks 46 or equivalently segments 110 and 120.

Figure 10:
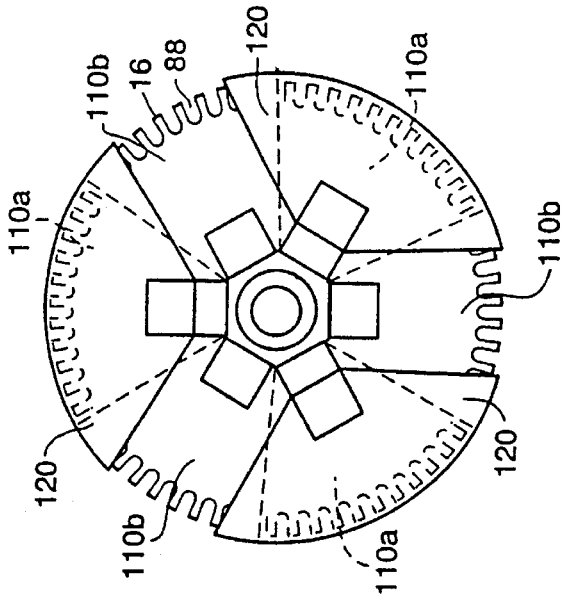
FIG. 10 is a front diagrammatic view of the propulsor disks of FIG. 7 showing in dotted outline the offset positioning of segments on rear propulsor disks behind ones on forward propulsor disks.

FIG. 10 is a front elevational view of propulsor unit 14 of FIG. 7 showing how segments 110*a*, 110*b*, and 120 are positioned relative to scraper plate 16 and to each other. In the illustrated embodiment, rear propulsor 24 is comprised of three non-overlapping propulsor segments 120, which when folded back to the rear of unit 14, are spaced far enough apart so as not to collide and therefore damage segments 120 by collision of one adjacent segment 120 against the other.

Similarly, the three propulsor segments 110*b* of propulsor 22 are arranged to cover the gaps between propulsor segments 120 when fully extended in the forward direction. Like segments 120, segments 110*b* are spaced far enough apart so that when they are folded to the rear, they do not destructively interfere or collide with each other. Segments 110*a* on front propulsor 20 are then provided in a manner offset between the gaps of segments 110*b* as illustrated in FIG. 10 and are similarly spaced apart from each other to avoid destructive interference or collision in their most rearward extension as limited by surface 118 of collar 116.

It can be seen from the depiction of FIG. 10 that rear propulsor segments 120 extend beyond the periphery of scraper plate 16 and thus blocks straight-through flow of fluid through nozzle cuts 88. Segments 110*a* and 110*b*, however, have a smaller radial dimension so that even when fully extended in the forward position, their outermost edges are at or below nozzle cuts 88 thereby providing unobstructed fluid flow around the periphery of segments 110*a* and *b* to hydrolyze the encrustation in front of propulsor unit 14.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. The following claims are, therefore, to be read to include not only the combination of elements which are literally set forth, but all equivalent elements for performing substantially the same function in substantially the same way to obtain substantially the same result. The claims are thus to be understood to include what is specifically illustrated and described above, what is conceptionally equivalent, and also what essentially incorporates the essential idea of the invention.

I claim:

1. An improvement in a pipe cleaning tool having a propulsor unit and a cutting head coupled to said propulsor unit for cleaning a pipe having fluid flowing therethrough, said propulsor unit for propelling said tool through said pipe by flow of said fluid through said pipe comprising:

a plurality of paired rotatable roller cutters disposed on said cutting head, each of said paired roller cutters being pivotally coupled as a pair to said cutting head by a corresponding roller cutter pivot rigidly disposed on said cutting head, the axis of rotation of each of the roller cutters being substantially parallel to the corresponding roller pivot and the axis of rotation of the roller cutters of each pair of roller cutters being spaced from and parallel to each other, so that radial disposition of each of said paired roller cutters with respect to said pipe cleaning tool is variable according to rotation thereof about its corresponding roller cutter pivot, the axis of rotation of the roller cutters of each pair of roller cutters being disposed on opposite sides of the corresponding roller cutter pivot so that movement of one of said roller cutters of each pair of roller cutters is generally radially opposite that of the other roller cutter of the same pair of roller of cutters, whereby bends and internal obstructions within a pipe cleaned by said pipe cleaning tool are accommodated by said paired rollers making contact with said pipe instead of one roller.

2. The improvement of claim 1 further comprising means for biasing each of said pairs of roller cutters in a predetermined radial disposition with respect to said cutting head.

3. The improvement of claim 2 further comprising a plurality of roller cutter cars, said roller cutters of each of said pairs of roller cutters being coupled to a respective one of said cars about said corresponding roller cutter pivot, each said car in turn being pivotally coupled to said cutting head by a car pivot pin.

4. The improvement of claim 3 wherein said means for biasing comprises a spring mechanism bearing against each said roller cutter car to rotate each said roller cutter car about its respective car pivot pin into a preferred disposition on said cutting head.

5. An improvement in a pipe cleaning tool having a propulsor unit and a cutting head coupled to said propulsor unit for cleaning a pipe having fluid flowing therethrough, said propulsor unit for propelling said tool through said pipe by flow of said fluid through said pipe comprising:

a plurality of paired roller cutters disposed on said cutting head, each of said paired roller cutters being pivotally coupled to said cutting head by a corresponding roller cutter pivot so that radial disposition of each of said paired roller cutters with respect to said pipe cleaning tool is variable according to rotation thereof about its corresponding roller cutter pivot; and a turbine-driven tracking device coupled to said cleaning tool for creating a fluctuating electromagnetic signal proportional to said flow of said fluid within said pipe by which said pipe tool may be tracked within said pipe and flow rate monitored, whereby bends and internal obstructions within a pipe cleaned by said pipe cleaning tool are accommodated by said paired rollers making contact with said pipe instead of one roller.

6. The improvement of claim 5 wherein said turbine-driven tracking device comprises a disk, a plurality of spaced apart permanent magnets affixed to said disk, and a turbine affixed to said disk for rotating said plurality of magnets in response to fluid flow past said tracking device.

7. An improvement in a pipe cleaning tool having an impulse propulsor unit and a cutting head coupled to said impulse propulsor unit for cleaning a pipe having fluid flowing therethrough, said impulse propulsor unit for propelling said tool through said pipe by flow of said fluid through said pipe comprising:

a plurality of paired roller cutters disposed on said cutting head, each of said paired roller cutters being pivotally coupled as a pair to said cutting head by a single common roller cutter pivot so that radial disposition of each of said paired roller cutters with respect to said pipe cleaning tool is variable according to opposite rotation of each one of said paired roller cutters about its corresponding single common roller cutter pivot; and wherein said impulse propulsor unit comprises at least one propulsor disk, said at least one disk comprising a plurality of rigid segments pivotally coupled to said pipe cleaning tool, so that bends and internal obstructions within a pipe cleaned by said pipe cleaning tool are accommodated by said paired rollers by collectively rotating about said single pivot instead of each roller rotating about separate pivots.

8. The improvement of claim 7 further comprising a peripheral extension coupled to each said segment so that the diameter of said propulsor disk formed therefrom can be increased without the need to replace said segments so that said pipe cleaning tool may be used in different sized pipes.

9. An improvement in a pipe cleaning tool having a propulsor unit and a cutting head coupled to said propulsor unit for cleaning a pipe having fluid flowing therethrough, said propulsor unit for propelling said tool through said pipe by flow of said through said pipe comprising:

a plurality of paired roller cutters disposed on said cutting head, each of said paired roller cutters being pivotally coupled to said cutting head by a corresponding roller cutter pivot so that radial disposition of each of said paired roller cutters with respect to said pipe cleaning tool is variable according to rotation thereof about its corresponding roller cutter pivot;

wherein said propulsor unit comprises at least one propulsor disk, said at least one disk comprising a plurality of rigid segments pivotally coupled to said pipe cleaning tool, and wherein said pipe cleaning tool has a longitudinal axis and wherein said propulsor unit has a plurality of said propulsor disks and wherein each of said propulsor disks are comprised of a plurality of said rigid segments, said plurality of segments on one propulsor disk being angularly offset about said longitudinal axis of said pipe cleaning tool with respect to said plurality of segments of another one of said propulsor disks so that longitudinal fluid flow past said pipe cleaning tool within said pipe impinges against at least one of said rigid segments whereby bends and internal obstructions within a pipe cleaned by said pipe cleaning tool are accommodated by said paired rollers making contact with said pipe instead of one roller.

10. The improvement of claim 9 wherein each of said segments on each said propulsor disk is angularly spaced one from the other such that said segments may be rotated in a rearward direction relative to forward movement of said pipe cleaning tool without substantial interference with other segments on the same propulsor disk to which said segments are coupled.

11. An improvement in a pipe cleaning tool having a propulsor unit and a cutting head coupled to said propulsor unit for cleaning a pipe having fluid flowing therethrough, said propulsor unit for propelling said tool through said pipe by flow of said fluid through said pipe comprising:

a plurality of paired roller cutters disposed on said cutting head, each of said paired roller cutters being pivotally coupled to said cutting head by a corresponding roller cutter pivot so that radial disposition of each of said paired roller cutters with respect to said pipe cleaning tool is variable according to rotation thereof about its corresponding roller cutter pivot;

wherein said propulsor unit comprises at least one propulsor disk, said at least one disk comprising a plurality of rigid segments pivotally coupled to said pipe cleaning tool, and wherein each of said segments has a radial outermost peripheral edge and further comprising a plurality of nozzles defined through said peripheral edge to define high velocity fluid flow through said peripheral edge for providing fluid jets for removing encrustations from said pipe, whereby bends and internal obstructions within a pipe cleaned by said pipe cleaning tool are accommodated by said paired rollers making contact with said pipe instead of one roller.

12. The improvement of claim 11 wherein each of said nozzles comprises a nozzle cut radially defined within a periphery of the respective segment.

13. An improvement in a pipe cleaning tool having an impulsive, propulsor unit and a cutting head coupled to said propulsor unit for cleaning a pipe having fluid flowing therethrough, said impulsive, nonturbine propulsor unit having a longitudinal axis generally oriented when said tool is operative to a longitudinal axis of said pipe, said impulsive, propulsor unit for propelling said tool through said pipe by flow of said fluid through said pipe by means of impulse forces generated by said impulsive, nonturbine propulsor unit in response to water pressure applied to said impulsive, nonturbine propulsor unit, wherein said impulsive, nonturbine propulsor unit comprises at least one propulsor disk, said at least one disk comprising a plurality of rigid segments pivotally coupled to said pipe cleaning tool, said rigid segments coupled to said pipe cleaning tool to reciprocate about an axis generally perpendicular to said longitudinal axis of said tool, wherein movement of said rigid segments is constrained to move between a first position substantially perpendicular to said longitudinal axis by a plate on one side of the at least one propulsor disk and a second position at an acute angle to the longitudinal axis by a collar having an inclined surface disposed on a second opposite side of the at least one propulsor disk.

14. The improvement of claim 13 further comprising a peripheral extension coupled to each said segment so that the diameter of said at least one propulsor disk formed therefrom can be increased without the need to replace said segments so that said pipe cleaning tool may be used in different sized pipes.

15. An improvement in a pipe cleaning tool having a propulsor unit and a cutting head coupled to said propulsor unit for cleaning a pipe having fluid flowing therethrough, said propulsor unit for propelling said tool through said pipe by flow of said fluid through said pipe, wherein said propulsor unit comprises at least one propulsor disk, said at least one disk comprising a plurality of rigid segments pivotally coupled to said pipe cleaning tool, wherein said pipe cleaning tool has a longitudinal axis and wherein said propulsor unit has a plurality of said propulsor disks and wherein each of said propulsor disks are comprised of a plurality of said rigid segments, said plurality of segments on one propulsor disk being angularly offset about said longitudinal axis of said pipe cleaning tool with respect to said plurality of segments of another one of said propulsor disks so that longitudinal fluid flow past said pipe cleaning tool within said pipe impinges against at least one of said rigid segments.

16. The improvement of claim 15 wherein each of said segments on each propulsor disk is angularly spaced one from the other such that said segments may be rotated in a rearward direction relative to forward movement of said pipe cleaning tool without substantial interference with other segments on the same propulsor disk.

* * * * *